US005701774A

United States Patent [19]

Imanari et al.

[11] Patent Number: 5,701,774

[45] Date of Patent: Dec. 30, 1997

[54] CONTROL DEVICE FOR A CONTINUOUS HOT-ROLLING MILL

[75] Inventors: Hiroyuki Imanari, Chofu; Hiroshi Otobe, Ooita, both of Japan

[73] Assignee: Kabushiki Kaisha Toshiba, Kawasaki, Japan

[21] Appl. No.: 808,506

[22] Filed: Feb. 28, 1997

Related U.S. Application Data

[63] Continuation of Ser. No. 374,908, Jan. 19, 1995.

[30] Foreign Application Priority Data

Jan. 19, 1994 [JP] Japan ..... 6-004001

[51] Int. Cl.[6] ..... B21B 37/00

[52] U.S. Cl. ..... 72/8.6; 72/11.4; 72/205

[58] Field of Search ..... 72/8.6, 8.7, 11.4, 72/12.3, 205

[56] References Cited

U.S. PATENT DOCUMENTS

| | | | |
|---|---|---|---|
| 4,307,591 | 12/1981 | Peterson | 72/12.3 |
| 4,507,946 | 4/1985 | Koyama et al. | 72/8.6 |
| 5,012,660 | 5/1991 | Peterson et al. | 72/12.3 |
| 5,040,395 | 8/1991 | Seki et al. | 72/8.6 |
| 5,103,662 | 4/1992 | Fapiano | 72/8.6 |
| 5,479,803 | 1/1996 | Imanari | 72/205 |
| 5,546,779 | 8/1996 | Ginzburg | 72/11.4 |

*Primary Examiner*—Lowell A. Larson
*Assistant Examiner*—Ed Tolan
*Attorney, Agent, or Firm*—Foley & Lardner

[57] ABSTRACT

A control device for the purpose of achieving highly precise rolled material. The response and robust stability of the rolled material tension and looper height are specified, and a controller is designed so that the rolling mill main motor and looper operate in concert to suppress variations in rolled material tension, thereby achieving stable optimum control which is responsive to the rolling state and rolling conditions.

3 Claims, 8 Drawing Sheets

(1) SENSITIVITY FUNCTION AND WEIGHTING FUNCTION (2) COMPLEMENTARY SENSITIVITY FUNCTION AND WEIGHTING FUNCTION

CONTROL DEVICE FOR A CONTINUOUS HOT-ROLLING MILL

This application is a continuation of application Ser. No. 08/374,908, filed Jan. 19, 1995.

DETAILED DESCRIPTION OF THE INVENTION

1. Background of the Invention

Field of Utilization in Industry

The present invention relates to a control device for a continuous hot-rolling mill, and more particularly to a control device for a continuous hot-rolling mill which performs strip (or rolled material) tension and looper control between the stands of the material being rolled in a tandem-type rolling mill.

2. Description of the Background Art

In a general rolling mill, automatic gauge (thickness) control (AGC) and automatic width control (AWC) are performed. By performing these two types of control, the desired values of sheet gauge and width, which are important measures of the quality of the rolled material, are achieved.

In the rolling mill, because the tension to which the material being rolled is subject during rolling influences the sheet thickness and sheet width, the tension is also simultaneously controlled.

In rolling mills, and particularly in hot-rolling mills in which the rolled material is heated, the deformation resistance of the rolled material is low, and the material can be easily be broken apart by a high applied tension. When the tension applied to the rolled material is set to a low value to prevent such breakage, externally applied disturbances and mis-settings can cause the rolled material to be in the tensionless condition. If this condition continues, a long loop of the rolled material can occur between stands, causing damage to the rolling mill.

For this reason, loopers are located between stands of the rolling mills to perform control of the tension in the rolled material. The looper height is also controlled constantly, thereby achieving good flow of the rolled material.

When such tension control and height control are performed by a looper, the rolled material tension interacts with the looper height, and the looper rotational speed interacts with the tension.

In the past, approaches to control in this type of rolling mill have included PID control of rolled material tension and looper height without suppressing these interactions, and the application of optimized control theory which applies linear quadratic control in a system that seek to suppress these interactions by the addition of a non-interactive compensation device, using either non-interactive control to independently control the tension and looper height or an optimized control method which applies linear quadratic control to treat the system as an interactive system in performing multivariable control of rolled material tension and looper height.

However, because the PID control method does not act to suppress the mutual interaction between the rolled material tension and the looper, it lacks fast response and stability. For that reason, non-interactive control and optimized control methods have seen much use recently.

In the non-interactive control method, a cross controller which calculates the manipulated variables to eliminate interaction is provided in the computer between the tension control system and the looper height control system for the purpose of performing non-interactive compensation. However, because the transfer function necessary to implement this cross controller is of high order, problems existed in practical application, such as cases in which significant differences exist between the model and the actual hardware, and in which the precision of the computer calculations was adversely affected.

In addition, while a basic required function of the looper is the suppression of variations in tension by means of movement of the looper, in non-interactive control, since the looper is controlled at a fixed height, this action of the looper is not sufficiently achieved, resulting in the problem of it not contributing to tension control.

In contrast with this non-interactive control, in the optimized control method, the weighting matrices Q and R, which are indicated in the performance criterion J {Equation (1))} are adjusted to find, by trial-and-error, the control gain which achieves balanced operation between the rolling mill main drive motor and the looper.

$$J = \int_{-\infty}^{\infty} (x^T Q x + u^T R u) dt; \tag{1}$$

where:

x is the state quantity of the process being controlled;

u is the manipulated variable provided by the controller to the controlled process;

$x^T$ is the transposition of x;

$u^T$ is the transposition of u; and t is time.

It is quite difficult to discover the causal relationship between the values of the weighting matrices Q and R in this performance criterion J and the actual response of the process, and this has been done by trial-and-error in the past. This brought about the problem of much time being required for the design of the control system and adjustment of actual hardware.

In addition, in this optimized control method because it is necessary to achieve a numerical solution to the Riccati equation, which is not solvable analytically, it is not possible to determine a general equation for the optimum control gain.

Because of this situation, in general a gain table in accordance with the properties of the rolled material and the rolling conditions was prepared beforehand, the optimum gain being obtained by a lookup from this table during actual operation.

However, it is not possible to make this gain table cover all possible conditions, so that the use of approximate values in unavoidable for some rolling conditions, this causing the problem of deterioration in control performance.

In addition, in the above-described non-interactive control and optimized control methods, because the controller is designed based on strict conformance with the model of the controlled process, the overall control system could exhibit instability when the actual process and the model differ. For this reason, the usual approach was to make somewhat of a sacrifice in response speed by lowering the control gain in order to maintain stability. Even when this was done, however, there was the problem of not having an index to indicate at how much difference between the actual process and the model instability of the control system occurred. This was in addition to the long time required for design and adjustment.

Furthermore, the H infinity method of control has come into use in recent years. Because this H infinity method enables a design for a high robust stability, it is possible to achieve a control system design with a high overall stability, including the controller.

In the above sense, robust stability is the measure of the overall control system stability when the controlled process experiences a change for some reason and even in the case in which there is a difference between the controlled process and the model thereof.

Even employing this H infinity control method, however, problems still existed because of the difficulty of designing a controller to suppress variations in tension, because of the non-interaction between the rolled material tension and the looper height.

Methods of designing the controller included the output feedback control method and the state feedback method, with state feedback control being generally used in combination with the optimized control method and output feedback being generally used in combination with the non-interactive control method.

A comparison of these output feedback and state feedback control methods is shown in Table 1.

TABLE 1

| Compared Item | State Feedback | Output Feedback |
|---|---|---|
| Fast control system response | No different than output feedback | No different than state feedback |
| Robust stability of the control system | Because more states are used, if the detection of state quantities is accurate, robust stability is better than that of output feedback. | Because only controlled quantities are used, the controller includes an observer. The error due to state predictions causes the robust stability to be worse than that of state feedback. |
| Ease of controller implementation | In general, the configuration is a simple one, consisting of only the constant state feedback gain and integrator. | Because an observer is included, the order of the controller becomes high. |
| Control interval (see note) and stability | Because of the simplicity of the controller, stability is maintained even if the control interval becomes long. | To implement a high-order controller, it is necessary to make the control interval short. |
| Other limitations | It is necessary to detect almost all state quantities. | (It is sufficient to detect only controlled quantities.) |

The control interval is not merely the calculation interval of the controller alone, but rather the time as measured from the detection of the state quantities or controlled quantities to the output of the manipulated variables. This control interval includes not only the calculation time required by the controller, which forms the central part of the looper multivariable control device, but also the delay times of intermediate transmission devices and the calculation times required by the controllers of the intermediate parts such as the main motor speed control device and the looper motor speed control device.

In view of this comparison, as long as it is possible to detect the state quantities, the state feedback configuration is preferable.

SUMMARY OF THE INVENTION

The present invention was made to solve the above-described problems, and has as an object the provision of a control device for a continuous hot-rolling mill, this control device performing optimized control of the tension on the rolled material, using the H infinity control method based on state feedback of the loopers located between each stand of a tandem rolling mill.

To achieve the above-noted object, the present invention provides a control device for a continuous hot-rolling mill having a number of stands, each of which are driven by a main electric motor, this control device having a main electric motor speed detector which detects the rotational speed of the rolling mill main electric motor, a main electric motor speed control means which compares the detected value of this speed detector with a main electric motor speed reference value and controls the rotational speed of the rolling mill main electric motor, a tension detection means which is disposed between the above-noted number of stands and which detects the tension of the material which is being rolled by the stands, a looper which controls the tension in the rolled material by means of having its height adjusted, a height detector which detects the height of the looper, a looper electric motor which drives and adjusts the height of the above-noted looper, a looper electric motor speed detector which detects the rotational speed of this looper electrical motor, and a looper electric motor speed control means which compares the detected value of this looper electric motor speed detector with a looper electric motor speed reference value and controls the drive speed of the looper electric motor, wherein the above-noted looper electric motor speed reference value is formed based on the detected values of the above-noted tension detector, height detector, and looper electric motor speed detector, this control device further having a setting means, a control gain calculation means, and a control calculation means, the above-noted setting means not only setting into the above-noted control calculation means the tension target value for the rolled material tension and the looper height target value, but also setting into the above-noted control gain calculation means the values of variables in the process model of the multivariable system, the weighting parameters for the purpose of reducing the tension variations in the above-noted looper height control system, the weighting function for the purpose of specifying the response and robust stability of the tension control system, and the weighting function for the purpose of specifying the response and robust stability of the looper height control system, the above-noted control gain calculation means calculating the control gain from the process model variable values, the weighting parameters of the looper height control system, and the weighting function of the tension control system, the above-noted control calculation means receiving the tension target value and looper height target value from the above-noted setting means, the control gain from the above-noted control gain calculation means, and the detected values from the above-noted main electric motor speed detector, looper electric motor speed detector, tension detector, and height detector, and calculating the rotational speed command value for the main motor speed controlling means which controls the speed of the main electric drive motor of the rolling mill, and the rotational speed command value for the looper main electric motor speed control means which controls the looper main electric motor.

Additionally, to achieve the above-noted object, the present invention provides a control device for a continuous hot-rolling mill of claim 1, in which the control calculation means has a state feedback configuration.

Yet additionally, to achieve the above-noted object, the present invention also provides a control device for a continuous hot-rolling mill of claim 1, in which the control gain calculation means holds the calculated control gain in a setting means, and wherein the control calculation means selects and outputs the thus-held control gain.

According to the present invention, based on the rolling conditions and rolling state of the rolling mill, in addition to the target tension value and looper height target value being set from the setting means into the control calculation means beforehand, the process model variable values, the weighting parameters for reducing the tension variations in the looper height control system, the weighting function for specifying the response and robust stability of the tension control system, and the weighting function for specifying the response and robust stability of the looper height control system are set from the setting means into the control gain calculation means.

In the control gain calculation means, calculations are performed on the process model variable values, the weighting parameters which reduce the tension variations in the looper height control system, the weighting function which specifies the response and robust stability of the tension control system, and the weighting function which specifies the response and robust stability of the looper height control system, thereby calculating the control gain. This calculated control gain is set into the control calculation means.

The control calculation means performs calculations on the tension target value and looper height target value from the setting means, the control gain from the control gain calculation means, and the detected value from the detection devices, thereby calculating the rotational speed command value for the main motor speed control means and the rotational speed command value for the looper main electric motor speed control means.

These rotational speed command values are sent to the main motor speed control means and looper main electric motor speed control means, to performed balanced control of the rolling mill main drive motor and looper drive motor.

By using a control calculation means with a state feedback configuration, even if the control interval of the control device of the continuous hot-rolling mill becomes long, stable control is achieved.

In addition, the control gain calculated by the control gain calculation means is held in the setting means, the control calculation means obtaining and setting the desired control gain based on the rolling conditions and rolling state.

DESCRIPTION OF THE PREFERRED EMBODIMENT

An embodiment of a control device for a continuous hot-rolling mill according to the present invention will be described below, with reference to the attached drawings.

Figure 1:
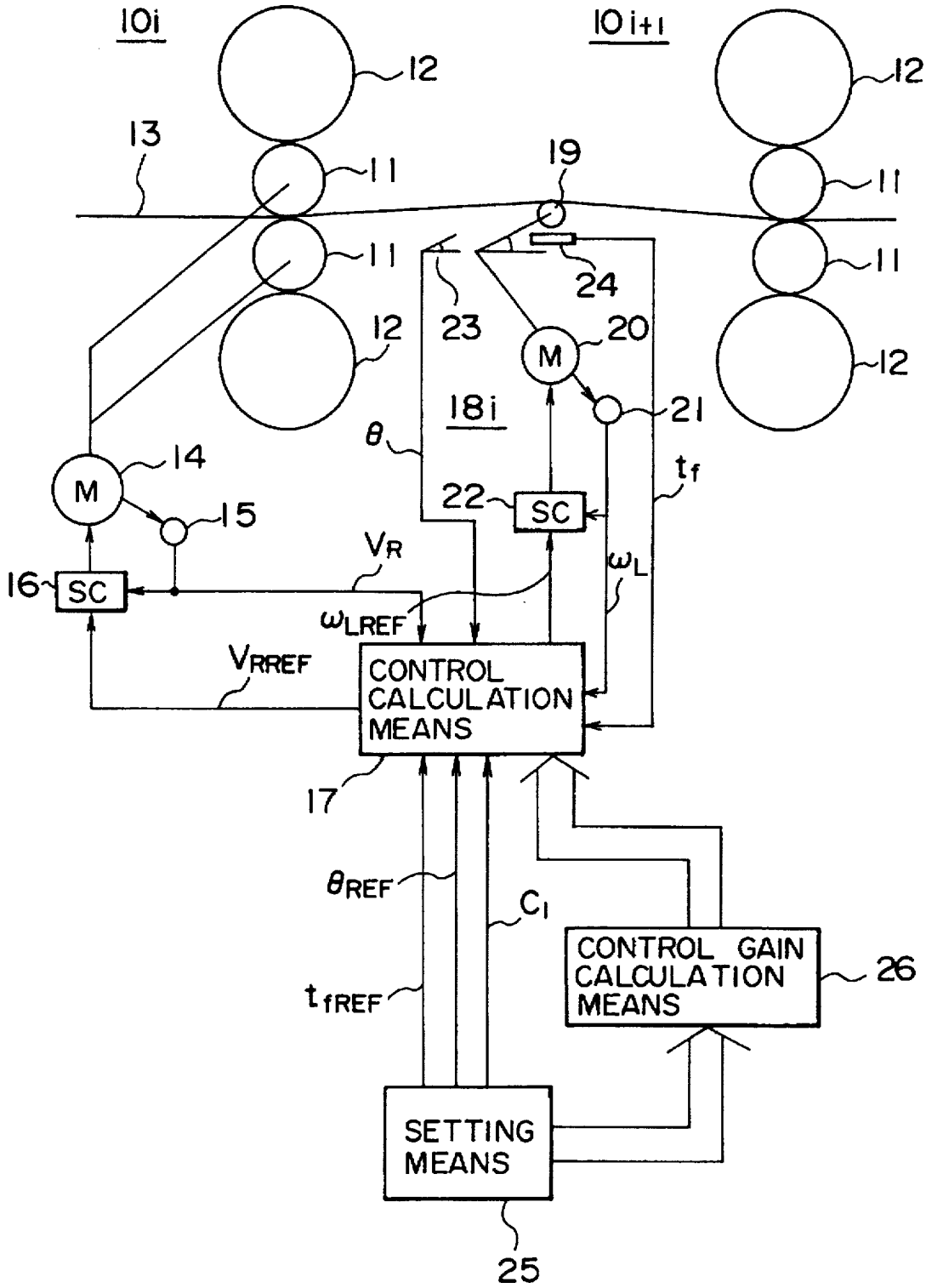
FIG. 1 is a block diagram which shows a general description of a control device for a hot-rolling mill according to the present invention.

FIG. 1 is a block diagram which shows the general configuration of a control device for a tandem-type continuous hot-rolling mill. This continuous hot-rolling mill has the 1st stand $\mathbf{10}_i$, the 2nd stand $\mathbf{10}_{i+1}$, and so forth. While there are usually five to seven of such stands, for the sake of simplicity in this description, just two stands will be used in the description.

These stands, the 1st stand $\mathbf{10}_i$ and the 2nd stand $\mathbf{10}_{i+1}$, have two work rolls 11, and two backup rolls 12. The rolled material 13 is inserted between these work rolls 11, this rolled material being successively rolled to the gauge (thickness) h and width b as it passes through each stand. A rolling mill main drive electric motor (referred to hereinafter as the main motor) 14 is linked to these work rolls, 11 via a drive shaft, and this main motor rotationally drives the work rolls 11 at the desired speed.

A main motor speed detector 15 is mounted to this main motor, this detector detecting the rotational speed of the main motor. A main motor speed control device 16 is connected to this main motor speed detector, this control device 16 performing control so that the deviation between the main motor speed detector detected value $V_R$ detected by the main motor speed detector 15 and the speed command value $V_{RREF}$ indicated by a control calculation means 17 is made small. The elements such as the main motor, main motor speed detector, and main motor speed control device are also provided at the stand $\mathbf{10}_{i+1}$l . To simplify this explanation, however, these have been omitted.

Between the stand $\mathbf{10}_i$ and the stand $\mathbf{10}_{i+1}$ a looper $\mathbf{18}_i$ is located. This looper $\mathbf{18}_i$ has a looper roll 19, which makes contact with the bottom edge of the rolled material 13, this looper roll 19 being rotated in response to the movement of the rolled material and a looper arm (not shown) which supports the looper roller 19 being rotationally driven by a looper drive electric motor (hereinafter referred to as the looper motor) 20 as its angle is adjusted via an arm. The looper motor 20 has mounted to it a rotational speed detection device 21, which detects the speed of the looper motor 20. A looper motor speed control device 22 is connected to this looper motor speed detection device 21, this performing control so that the deviation between the looper motor speed $\omega_L$ and the rotational speed command value $\omega_{LREF}$ indicated by the control calculation means 17 is made small.

A detection device 23 is provided on this looper $\mathbf{18}_i$, this detection device 23 detecting the looper height θ, which is the looper $\mathbf{18}_i$ arm height converted to an angle. The looper height θ which is detected by the looper height detection device 23 is sent to the control calculation means 17. A tension detection device 24, which is mounted to the bottom part of the axis of the looper roll 19, detects the tension $t_f$ in the rolled material 13. The tension $t_f$ which is detected by the tension detection device 24 is sent to the control calculation means 17.

The control device of this continuous hot-rolling mill is provided with a setting means 25, a control gain calculation means 26, and a control calculation means 17.

The setting means 25 sets into the control calculation means 17 values such as the rolled material tension target value $t_{fREF}$, the looper height target value $\theta_{REF}$, and weighting parameter $C_1$ which reduces the tension variations in the looper height control system.

The setting means 25 also sets into the control gain calculation means 26 such values as the variables and weighting parameter values which form the process model, the weighting function which specifies the response and robust stability of the tension control system, and the weighting function which specifies the response and robust stability of the looper height control system.

The control gain calculation means 26 receives such values as the variables and weighting parameters of the process model, the weighting function of the tension control system, and weighting function of the looper height control system, and calculates the control gain to be set into the control calculation means 17, in accordance with the appropriate equations.

The control calculation means 17 receives such values as the tension target value $t_{fREF}$, the looper height target value $\theta_{REF}$, and weighting parameter $C_1$ from the setting means 25, the control gain from the control gain calculation means 26, the looper height $\theta$ which is detected by the looper height detection device 23, the main motor speed detection value $V_R$ which is detected by the main motor speed detection device 15, and the looper motor speed $\omega_L$ which is detected by the rotational speed detection device 21, and performs control calculations to calculate the rotational speed command value $V_{RREF}$ for the main motor 14 and the rotational speed command value $\omega_{LREF}$ for the looper motor 20.

Figure 2:
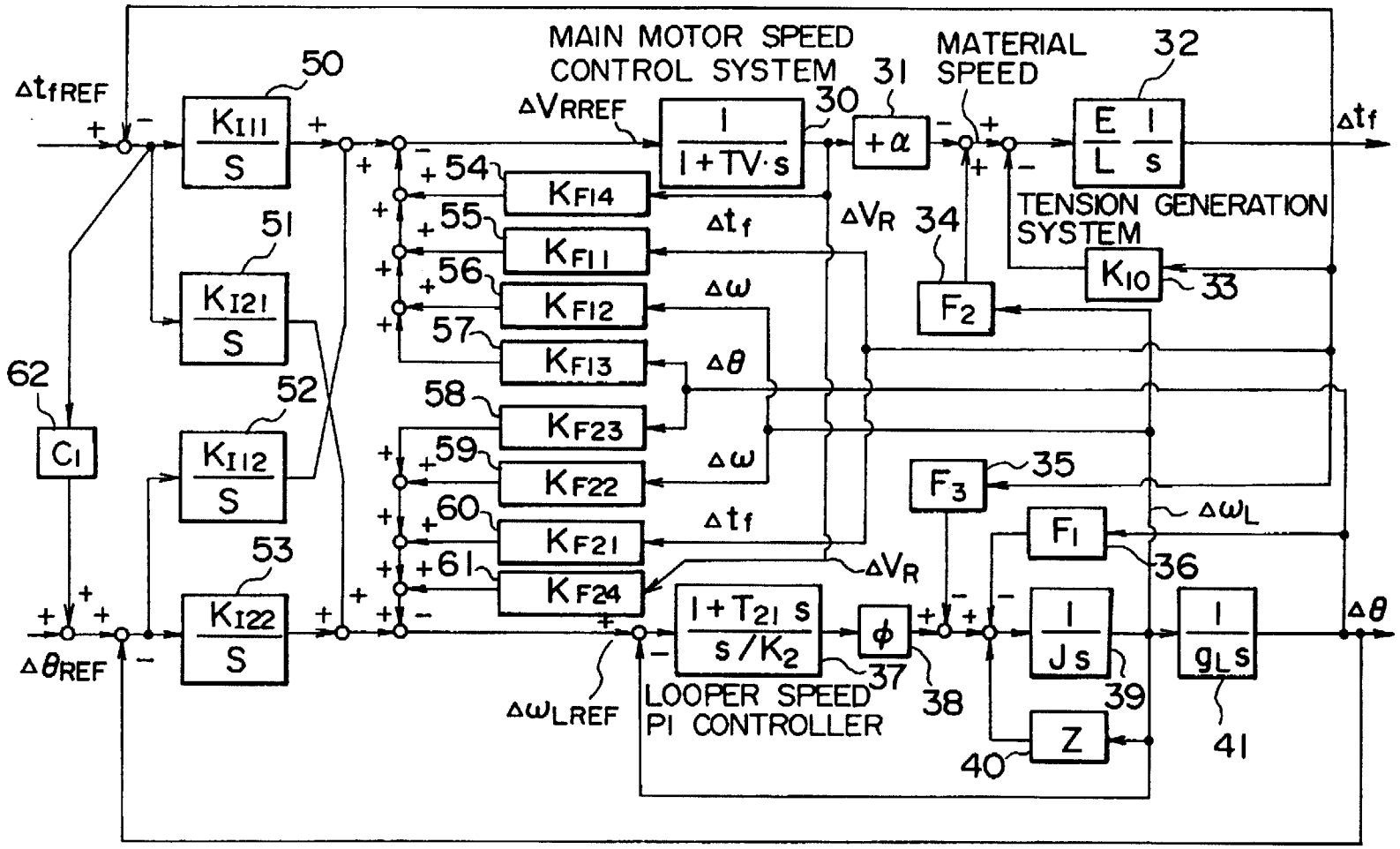
FIG. 2 is a block diagram which shows a general description of a control calculation means.

FIG. 2 is a block diagram of the control device of a continuous hot-rolling mill of FIG. 1, with the setting means 25 and control gain calculation means 26 removed. In this control system, the tension control system which performs control of the tension $\Delta t_f$ based on the tension target value $\Delta t_{fREF}$ and the looper height control system which performs control of the looper height $\Delta\theta$ based on the looper height target value $\Delta\theta_{REF}$ are linked by means of the weighting parameter $C_1$, so that looper height control is performed responsive to the tension control.

Because this block diagram represents a linear model, the amounts of variation of various quantities such as the tension target value are prefixed with $\Delta$ (e.g., $\Delta tr_{fREF}$ for the tension target value).

In FIG. 2, the 1st stand $\mathbf{10}_i$, 2nd stand $\mathbf{10}_{i+1}$, rolled material 13, main motor 14, main motor speed detector 15, main motor speed control device 16, looper $\mathbf{18}_i$, looper roll 19, looper motor 20, speed detection device 21, looper motor speed control device 22, looper height detection device 23, and tension detection device 24 of FIG. 1 are indicated by blocks 30 to 40.

The main motor speed control system is formed by the main motor 14, the main motor speed detection device 15, and the main motor speed control device 16, this being indicated by the single block 30. The coefficient representing the influence of the main motor speed on the rolled material speed is indicated by block 31. The tension generating gain and an integrator $(L/E)\cdot(1/S)$ in the tension generating process are indicated by block 32. The feedback $K_{10}$ in the tension generating process is indicated by block 33. These blocks 32 and 33 represent a model of the tension generating mechanism.

The influencing coefficient $F_2$ representing the influence of the looper motor rotational speed on the rolled material speed is indicated by block 34, the influencing coefficient $F_3$ representing the influence of the rolled material tension on the looper motor torque is indicated by block 35, the gain $F_1$ from the looper height with respect to the looper motor torque is indicated by block 36, the looper motor torque constant $\phi$ is indicated by block 38, the transfer function 1/JS from the torque of the looper motor with respect to the rotational speed is indicated by block 39, the looper damping coefficient Z is indicated by block 40, and the transfer function $1/g_L S$ from the looper motor rotational speed with respect to the looper height is indicated by block 41.

The looper motor speed control device 22 is indicated by block 37 as a PI control system. The looper speed control system is formed by the looper motor 20, the speed detection device 21, and the looper motor speed control device 22, this being indicated by the minor loop formed by blocks 37, 38, 39, and 40.

The control calculation means 17 is indicated by the integral controller of blocks 50, 51, 52, and 53, and by the feedback controllers of blocks 54, 55, 56, 57, 58, 59, 60, and 61, with the weighting parameter $C_1$ which is set into the setting means 25 being indicated by block 62. This weighting parameter $C_1$ links the tension control system to the looper height control system, resulting in good balance between these two control systems.

Equations (2) and (3) show the state equations of the model of the controlled process from block 30 to block 41.

$$\begin{vmatrix} \Delta\dot{t}_f \\ \Delta\dot{\omega}_L \\ \Delta\dot{\theta} \\ \Delta\dot{V}_R \\ \Delta\dot{X}_H \end{vmatrix} = \begin{vmatrix} \frac{-E\cdot K_{10}}{L} & \frac{E\cdot F_2}{L} & 0 & \frac{-E\cdot\alpha}{L} & 0 \\ \frac{-F_3}{J} & \frac{-\phi K_2\cdot T_{21}-Z}{J} & \frac{-F_1}{J} & 0 & \frac{\phi}{J} \\ 0 & \frac{1}{g_L} & 0 & 0 & 0 \\ 0 & 0 & 0 & -\frac{1}{T_V} & 0 \\ 0 & -K_2 & 0 & 0 & 0 \end{vmatrix} \cdot \begin{vmatrix} \Delta t_f \\ \Delta\omega_L \\ \Delta\theta \\ \Delta V_R \\ \Delta X_H \end{vmatrix} + \begin{vmatrix} 0 & 0 \\ 0 & \frac{\phi K_2 T_{21}}{J} \\ 0 & 0 \\ \frac{1}{T_V} & 0 \\ 0 & K_2 \end{vmatrix} \cdot \begin{vmatrix} \Delta V_{RREF} \\ \Delta\omega_{LREF} \end{vmatrix} \quad (2)$$

-continued $$\begin{vmatrix} \Delta t_f \\ \Delta\theta \end{vmatrix} = \begin{vmatrix} 1 & 0 & 0 & 0 & 0 \\ 0 & 0 & 1 & 0 & 0 \end{vmatrix} \cdot \begin{vmatrix} \Delta t_f \\ \Delta\omega_L \\ \Delta\theta \\ \Delta V_R \\ \Delta X_H \end{vmatrix} + \begin{vmatrix} 0 & 0 \\ 0 & 0 \end{vmatrix} \cdot \begin{vmatrix} \Delta V_{RREF} \\ \Delta\omega_{LREF} \end{vmatrix} \quad (3)$$

In the above equations, the Δ prefix before symbols indicates an infinitesimal change and the dots over the symbols indicate the derivative with respect to time. Therefore the derivative of $\Delta t_f$ with respect to time is indicated as shown below.

$$\Delta t_f d(\Delta t_f)/dt$$

If we indicate the transposition by $^T$, we have the following.

State vector $x=[\Delta t_f\ \Delta\omega_L\ \Delta\theta_L\ \Delta V_R\ \Delta x_H]^T$ Output vector $y=[\Delta t_f\ \Delta\theta_L]^T$ Input vector $u=[\Delta V_{RREF}\ \Delta\omega_{LREF}]^T$ If the state equations are written in terms of the state vector x, the output vector y, and the input vector u, we have the following.

$$\begin{cases} \dot{x} = Ax + Bu \\ y = Cx \end{cases} \quad (4)$$

The matrices in the above are as follows.

$$\text{Matrix } A = \begin{vmatrix} \frac{-E \cdot K_{10}}{L} & \frac{E \cdot F_2}{L} & 0 & \frac{-E \cdot \alpha}{L} & 0 \\ \frac{-F_3}{J} & \frac{-\phi K_2 \cdot T_{21} - Z}{J} & \frac{-F_1}{J} & 0 & \frac{\phi}{J} \\ 0 & \frac{1}{gL} & 0 & 0 & 0 \\ 0 & 0 & 0 & -\frac{1}{T_V} & 0 \\ 0 & -K_2 & 0 & 0 & 0 \end{vmatrix}$$

$$\text{Matrix } B = \begin{vmatrix} 0 & 0 \\ 0 & \frac{-\phi K_2 T_{21}}{J} \\ 0 & 0 \\ \frac{1}{T_V} & 0 \\ 0 & K_2 \end{vmatrix}$$

$$\text{Matrix } C = \begin{vmatrix} 1 & 0 & 0 & 0 & 0 \\ 0 & 0 & 1 & 0 & 0 \end{vmatrix}$$

where:

$g_L$ is the gear ratio between the looper roll and the looper motor;

J is the moment of inertia of the looper motor;

$K_{10}$ is the tension feedback coefficient;

E is the Young's modulus of the rolled material;

L is the distance between stands;

$t_f$ is the forward tension;

$V_R$ is the main motor speed;

Z is the looper damping coefficient;

α is the coefficient of influence of the main motor speed on the rolled material speed;

θ is the looper height (indicated as an angle);

ϕ is the torque constant of the looper motor;

$\omega_L$ is the rotational speed of the looper;

$T_v$ is the time constant of the main motor speed control system;

$F_1$ is the gain from the looper height to the looper drive torque (load torque which is dependent upon the rolled material weight and the weight of the looper itself);

$F_2$ is the coefficient of influence of the looper rotational speed on the rolled material speed;

$F_3$ is the coefficient of influence of the tension on the looper motor torque;

$x_H$ is a variable within the looper speed control system;

$K_2$ is a control constant of the looper speed control system;

$T_{21}$ is a control constant of the looper speed control system; and

Subscript REF indicates a command value.

In the looper height control system, if we add the weighting parameter $C_1$ to the equation (3) which is to control both the looper height θ an the rolled material tension $t_f$, we have the following equation (5).

$$\begin{vmatrix} \Delta t_f \\ \Delta y_2 \end{vmatrix} = \begin{vmatrix} 1 & 0 & 0 & 0 & 0 \\ C_1 & 0 & 1 & 0 & 0 \end{vmatrix} \cdot \begin{vmatrix} \Delta t_f \\ \Delta\omega_L \\ \Delta\theta \\ \Delta V_R \\ \Delta X_H \end{vmatrix} + \begin{vmatrix} 0 & 0 \\ 0 & 0 \end{vmatrix} \cdot \begin{vmatrix} \Delta V_{RREF} \\ \Delta\omega_{LREF} \end{vmatrix}; \quad (5)$$

In Equation (5), controlled quantity Δθ in Equation (3) changes to $\Delta y_2$ as indicated in Equation (6).

$$\Delta y_2 C_1 \Delta t_f + \Delta\theta \quad (6)$$

If the weighting parameter $C_1$ is made large, the relative weight of the rolled material tension $t_f$ becomes large, so that good control of the rolled material tension is achieved by changing the looper angle. However, this will cause the change in the looper angle θ to become large.

On the other hand, if the weighting parameter $C_1$ is made small, the relative weight of the rolled material tension $t_f$ becomes small, causing a change in the direction in which the looper height θ is controlled to be constant.

In Equation (5), if the weighting parameter $C_1$ is made zero, this becomes equivalent to the process model of the past, indicated by Equation (3), the looper angle being held constant, and the control performance being equivalent to the non-interactive control used in the past.

It can be seen that the significance of the weighting parameter is that, in the case in which a deviation exists between the rolled material tension target value $\Delta t_{fREF}$ and the tension Ate, a change of $C_1$ ($\Delta t_{REF} - \Delta t_f$) is made from the looper height θ which is the target value for the looper height, thereby absorbing the variation in tension.

If $C_1$ is made larger, the value $K_{I11}$ of controller 51 and the value $K_{F21}$ of controller 60 become larger to depress the variation of tension. This means that the amount of $C_1$ can be adjusted to depress the variation of tension.

The integral controller of blocks 50, 51, 52, and 53, and the feedback controllers of blocks 54, 55, 56, 57, 58, 59, 60, and 61 are established as follows.

Figure 3:
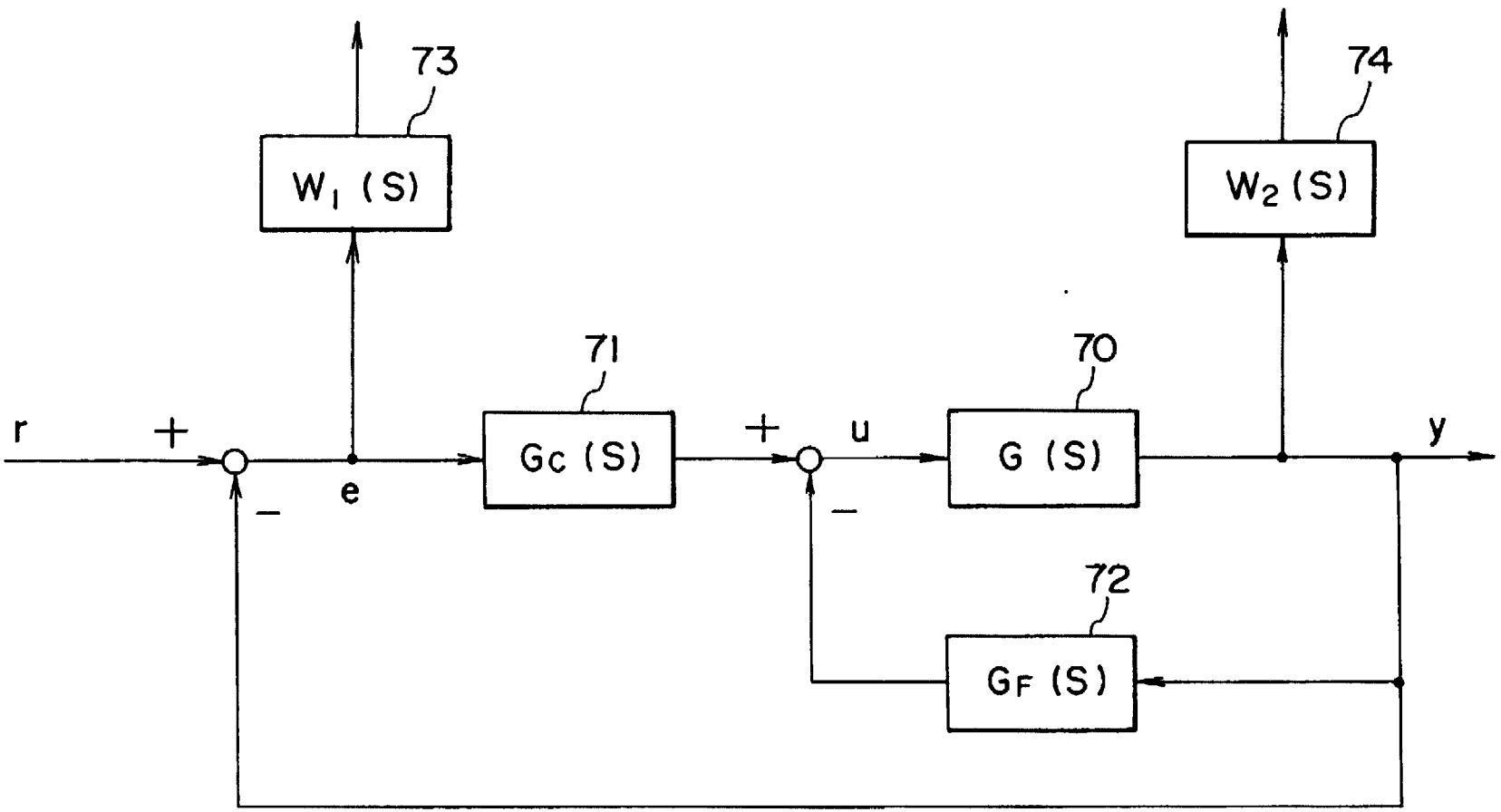
FIG. 3 is a block diagram which shows the main part of the control calculation means of FIG. 2.

This is basically done by means of the H infinity control method. While this H infinity control method can be implemented with either a state feedback configuration or an output feedback configuration, in the present invention, to prevent instability in a high-order controller, the state feedback configuration is used, the block diagram of this being shown in FIG. 3. In FIG. 3, to simplify the explanation the case of one input and one output is used, although this can be applied as well to the case, for example, as shown in FIG. 2, in which there are two inputs and two outputs.

In FIG. 3, 70 is the transfer function G(s) of the control process indicated by blocks 30 to 41, 71 is the main controller $G_c$ (s) indicated by blocks 50 to 53, 72 is the feedback controller $G_F(s)$ indicated by blocks 54 to 61, 73 is the weighting function W1(s) (known as the "sensitivity function") which establishes the transfer function from the target value r to the control deviation e, and 74 is the transfer function $W_2(s)$ (known as the "complementary sensitivity function") from the target value r to the control quantity y.

In the H infinity control method, the control problem is formulated in terms of achieving the desired response for the sensitivity function and the complementary sensitivity function, the object being to determine a main controller $G_c(s)$ and feedback controller $G_F(s)$ which will achieve the desired response.

Figure 4:
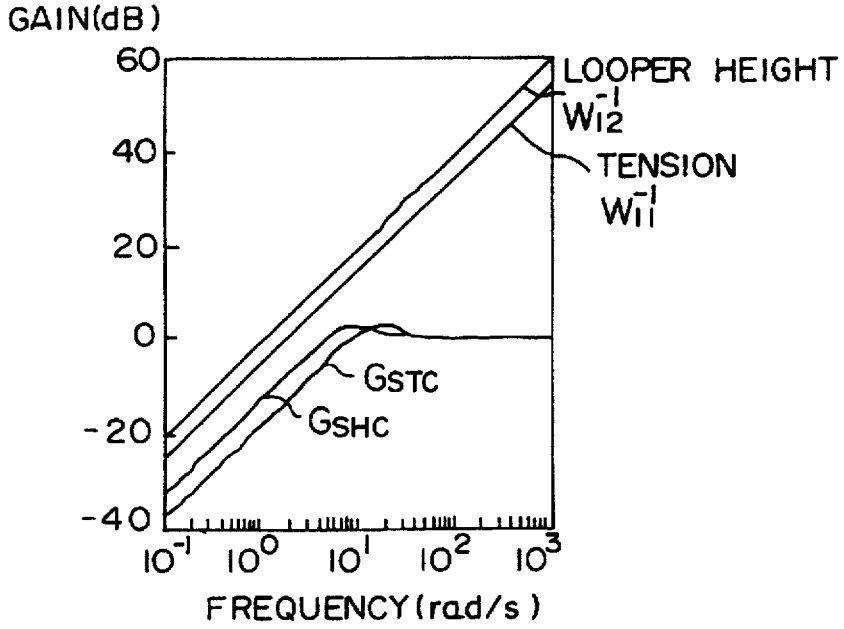
FIG. 4 shows the gain versus frequency characteristics of a control device for a hot-rolling mill according to the present invention.
Figure 5:
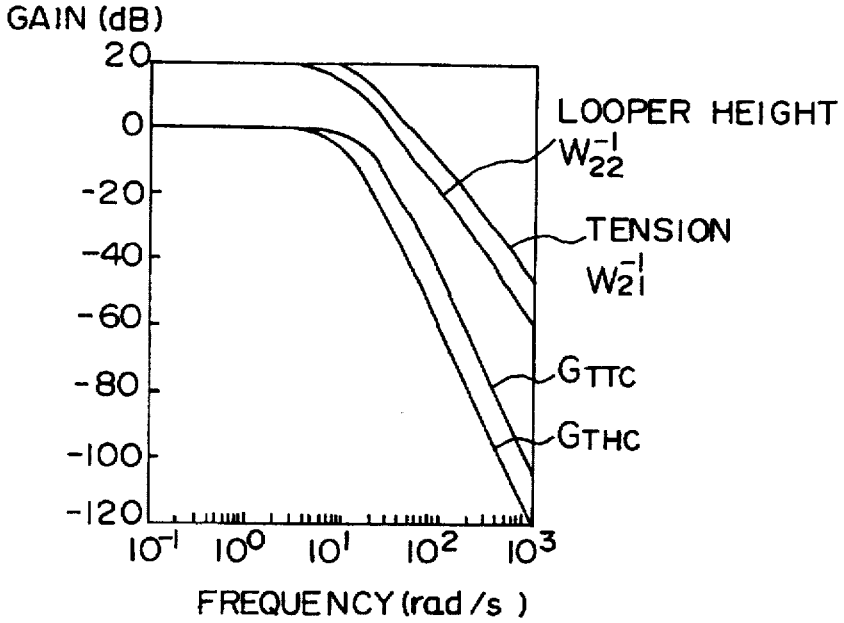
FIG. 5 shows the gain versus frequency characteristics of a control device for a hot-rolling mill according to the present invention.

FIG. 4 and FIG. 5 show one example of establishing the sensitivity function and complementary sensitivity function for the looper multivariable system shown in FIG. 2.

FIG. 4 shows the sensitivity function $G_{STC}$ of the tension control system, the sensitivity function $G_{SHC}$ of the looper height control system, and the weighting function $W_{12}^{-1}$ corresponding to the sensitivity function $G_{SHC}$ of the looper height control system.

FIG. 5 shows the complementary sensitivity function $G_{TTC}$ of the tension control system, the sensitivity function $G_{THC}$ of the looper height control system, and the weighting function $W_{22}^{-1}$corresponding to the sensitivity function $G_{THC}$ of the looper height control system.

As shown by these responses, it is usual to establish the weighting functions so that the gain of the sensitivity function $G_{STC}$ is low in the low-frequency region and so that the gain of the complementary sensitivity function $G_{THC}$ is low in the high-frequency region. The reasons for this are as follows.

(A) There is the imposed limitation of (sensitivity function)+(complementary sensitivity function)=1.

(B) In general, the sensitivity function is mainly related to the response of the control system. Therefore, to increase the response, it is necessary to make the sensitivity function small.

(C) The complementary sensitivity function is mainly related to the robust stability of the control system. Therefore, to increase the robust stability, it is necessary to make the complementary sensitivity function small.

To achieve the object of (B), the gain of the sensitivity function can be made small over the entire frequency range, and to achieve the object of (C), the gain of the complementary sensitivity function can be made small over the entire frequency range. However, because of the limitation of (A), it is impossible to make both small over the entire frequency range simultaneously. Therefore, it is sufficient to have the controlled quantity track to the target value in the low-frequency range only, and therefore the gain of the sensitivity function is made small in the low-frequency region.

From the standpoint of noise immunity as well, the gain between the target value and the controlled value is made small in the high-frequency region, and to improve robust stability the gain of the complementary sensitivity function is made small in the high-frequency region.

More specifically, the sensitivity function $G_{STC}$ is an index that expresses the response speed of tension control, the sensitivity function $G_{SHC}$ is an index that expresses the response speed of looper height control, the complementary sensitivity function $G_{TTC}$ is an index which expresses the robustness of tension control, and the complementary sensitivity function $G_{THC}$ is an index which expresses the robust stability of looper height control.

As described above, the sensitivity function and the complementary sensitivity function are the closed-loop responses after the weighting functions are set and control is calculated, with the sensitivity function $G_{STC}$ and the complementary sensitivity function $G_{TTC}$ related to tension control being established by the weighting functions $W_{11}^{-1}$ and $W_{21}^{-1}$, and the sensitivity function $G_{SHC}$ and the complementary sensitivity function $G_{THC}$ related to looper height control being established by the weighting functions $W_{12}^{-1}$ and $W_{22}^{-1}$.

The index of response speed is the frequency in the region of which the sensitivity function crosses the O-dB line, this being an angular frequency of 7 rad/s in the case of tension control response.

The index of robust stability is the difference between the weighting function $W_{22}^{-1}$ and the complementary sensitivity function $G_{THC}$, which is approximately 20 dB.

What this means is that even if, for example, there were to be an error of approximately 20 dB (10-fold difference) between the process model and the actual process, stability would still be maintained. Designing for a large robust stability means achieving stable control even if the process under control varies over a wide range, which means that a wide range of rolling conditions can be accommodated with a single controller gain. This eliminates the need to have a large number of difference controller gains.

In this embodiment of the present invention, process model parameters and the above-described weighting functions for the H infinity control method which are suited for the rolling conditions and rolling state are set into the control gain calculation means 26 by the setting means 25. At the control gain calculation means 26, these parameters and weighting functions are used to calculate the control gain based on Equations (2) and (5), using the H infinity control method. The control gain calculated by the control gain calculation means 26 is set into the control calculation means 17. Using an index of the robust stability of the above-described H infinity control, a comparison is made between the next rolling conditions and rolling state and the previous rolling conditions and rolling state, and if the robust stability index indicates a range within which the next set of conditions and states can be accommodated, the past control gain can used for the next rolling.

Figure 6A:
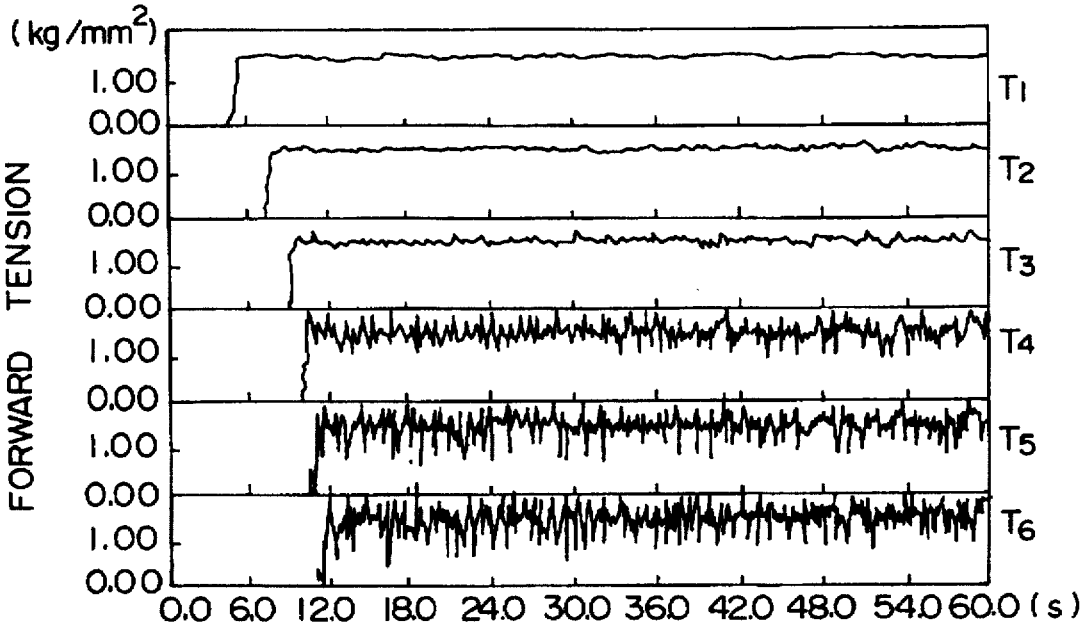
FIG. 6A shows the relationship of tension to time for a control device for a hot-rolling mill according to the present invention, and FIG. 6B show shows the relationship of tension to time for a hot-rolling mill of the past.
Figure 6B:
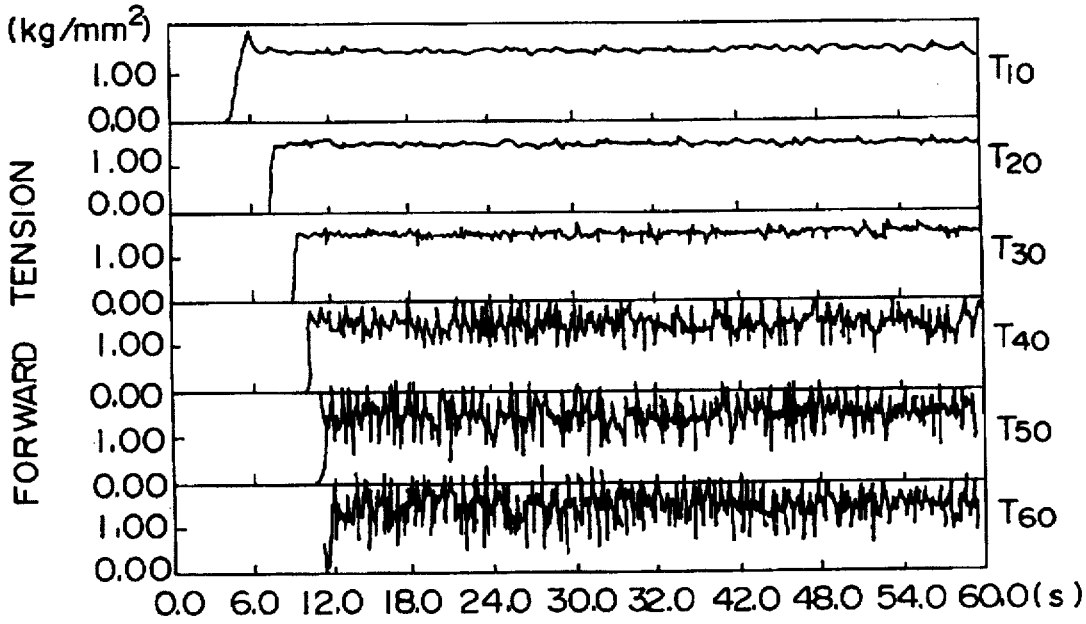
Figure 7A:
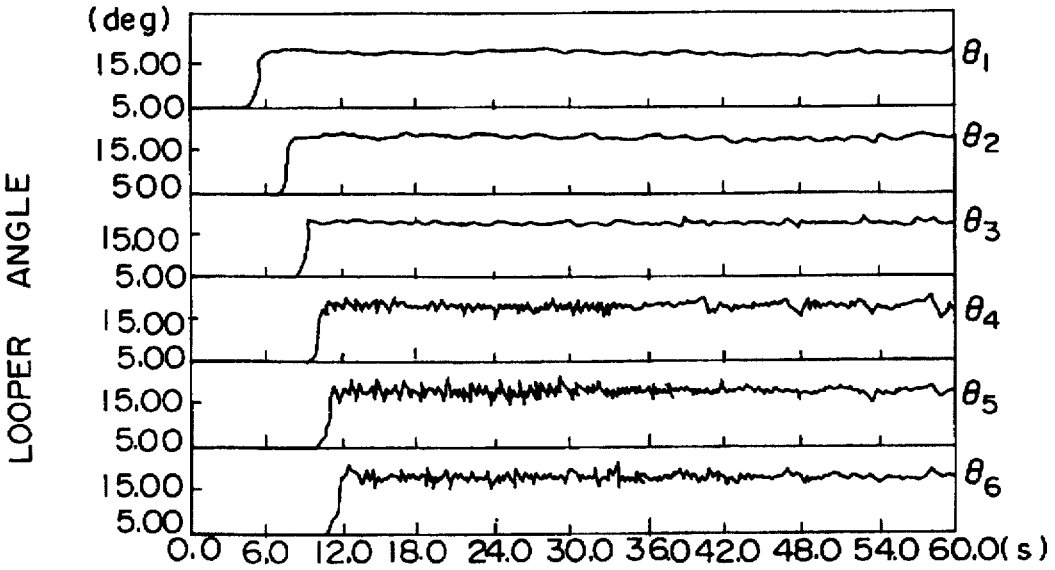
FIG. 7A shows the relationship of looper height to time for a control device for a hot-rolling mill according to the present invention.
Figure 7B:
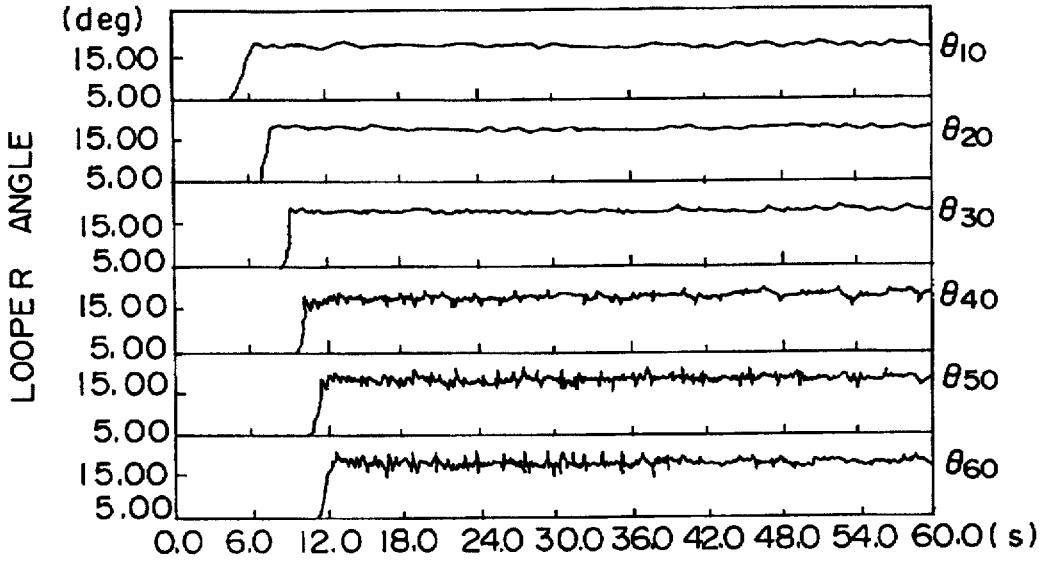
FIG. 7B shows the relationship of looper height to time for a hot-rolling mill of the past.
Figure 8A:
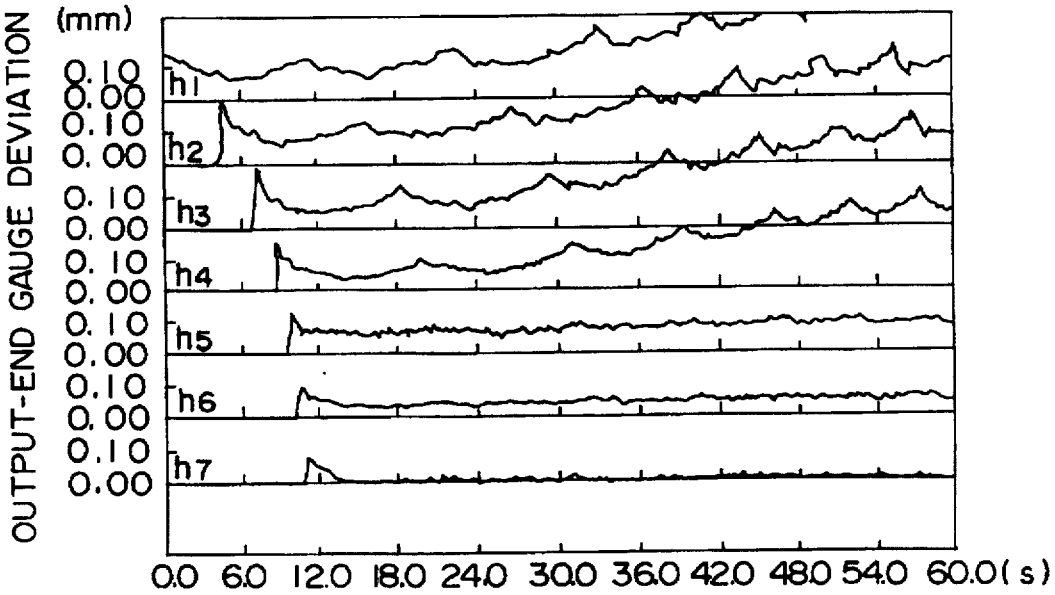
FIG. 8A shows the relationship of output-end gauge varitions to time for a control device for a hot-rolling mill according to the present invention.
Figure 8B:
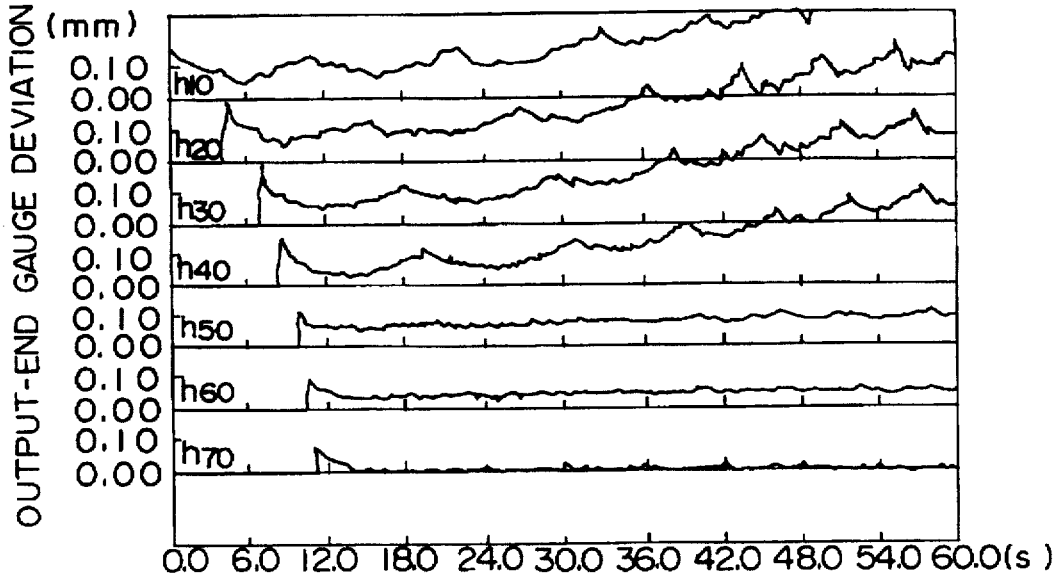
FIG. 8B shows the relationship of output-end gauge variations to time for a control device for a hot-rolling mill of the past.

FIG. 6A shows the forward tension with respect to time in the control method of the present invention, FIG. 7A indicates the looper angle with respect to time in the control system of the present invention, and FIG. 8A indicates the output gauge (thickness) with respect to time in the control method of the present invention, these three being the results of a simulation of the 7th stand, $\mathbf{10}_{i+6}$. FIG. 6B shows the forward tension with respect to time, FIG. 7B shows the looper angle with respect to time, and FIG. 8B shows the output-end gauge (thickness) with respect to time, each of these three being for the optimized control method of the past, and indicating the results of a simulation of the 7th stand, $\mathbf{10}_{i+6}$.

The variable values during the simulation and the variable values used in the controller design were varied as shown below, and the effect of making these changes was investigated.

(1) The tension feedback coefficient during the simulation, $K_{10}$=0.5×tension feedback coefficient $K_{10}$ used the design of the controller.

(2) The Young's modulus used during the simulation, E=3.0×Young's modulus E used in the design of the controller.

(In both cases, the variable values were varied in the direction such that the tension variation was larger than in the design.)

In FIGS. 6A and 6B, $T_1$ and $T_{10}$ are the tensions between the 1st stand $\mathbf{10}_i$ and the 2nd stand $\mathbf{10}_{i+1}$ for the control method of the present invention and optimized control method of the past, respectively. Similarly, $T_2$ and $T_{20}$ are the tensions between the 2nd stand 10*i+1* and the 3rd stand $\mathbf{10}_{i+2}$, and so forth, with T6 and T60 being the tensions between the 6th stand $\mathbf{10}_{i+5}$ and the 7th stand $\mathbf{10}_{i+6}$, for the control method of the present invention and optimized control method of the past, respectively. In FIGS. 7A and 7B, θ1 and θ10 are the loop heights between the 1st stand $\mathbf{10}_i$ and the 2nd stand $\mathbf{10}_{i+1}$ for the control method of the present invention and optimized control method of the past, respectively. Similarly, $\theta_2$ and $\theta_{20}$ are the loop heights between the 2nd stand $\mathbf{10}_{i+1}$ and the 3rd stand $\mathbf{10}_{i+2}$, and so forth, with $T_6$ and $T_{60}$ being the loop heights between the 6th stand $\mathbf{10}_{i+5}$ and the 7th stand $\mathbf{10}_{i+6}$, for the control method of the present invention and optimized control method of the past, respectively. In FIGS. 8A and 8B, h1 and $h_{10}$ are the deviations from the gauge target value between the 1st stand $\mathbf{10}_i$ and the 2nd stand $\mathbf{10}_{i+1}$ for the control method of the present invention and optimized control method of the past, respectively. Similarly, $h_2$ and $h_{20}$ are the deviations from the gauge target value between the 2nd stand $\mathbf{10}_{i+1}$ and the 3rd stand $\mathbf{10}_{i+2}$, and so forth, with $T_6$ and $T_{60}$ being the deviations from the gauge target value between the 6th stand $\mathbf{10}_{i+5}$ and the 7th stand $\mathbf{10}_{i+6}$, for the control method of the present invention and optimized control method of the past, respectively.

The process under control in these simulations are not the simplified model indicated by blocks 30 to 40 in FIG. 2, but rather included consideration of the rolling phenomenon and tension generation process between the rolls as non-linear processes.

Consideration was also given to external disturbances, such as skid marks and roll eccentricity which occur during hot rolling, as well as to such system elements as the main motor control system, the looper control device, and the automatic gauge control system, enabling the achievement of a simulation which closely approximates a rolling mill as actually used. In addition, in these simulations accelerated rolling was performed from 27 seconds to 53 seconds, with a shortened disturbance period in the latter half of the simulation.

It is clear from these simulations that while tension vibration does not occur with the control method of the present invention, it does occur from 15 seconds up to 35 seconds with the optimized control method of the prior art. Therefore, compared with the optimized control method of the past, the control method of the present invention is capable of achieving a control device which has a higher degree of robust stability.

With the optimized control method of the past, to achieve the desired control performance, setting the values of the performance criteria, matrices Q and R, required repeated trial-and-error settings. For that reason, much time and labor was required in setting these values.

However, with the control method of the present invention, it is easy to achieve a control design which considers response speed and robust stability in the frequency domain.

In addition, if it is desired to suppress tension variations not only in the main electric motor, but also in the looper height control system, it is merely necessary to adjust the weighting parameter $C_1$.

In the control method of the present invention, as shown in FIG. 1, setting means 25 is connected to the control calculation means 17 via the control pain calculation means 26, so that the control calculation means 17 is set by making a decision as to whether, after a change in rolling conditions and rolling state the previously calculated control gain robust stability limits will be exceeded.

Figure 9:
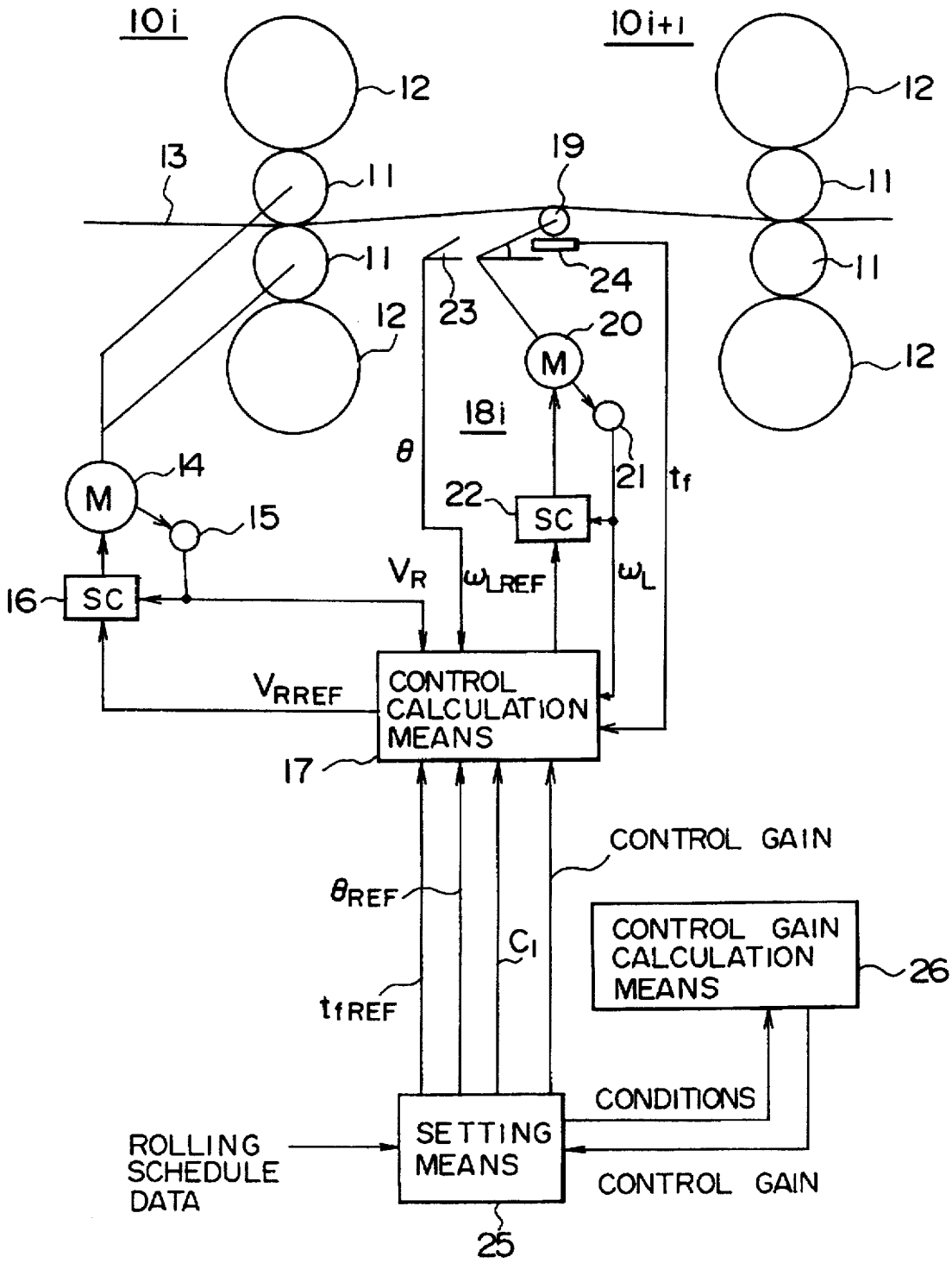
FIG. 9 shows the block diagram to another configuration of a control device for a hot-rolling mill according to the present invention.

This calculation is made, as shown in FIG. 9, by setting means 25 and control gain calculation means 26, the resulting control gain being stored in a table of setting means 25, this being selectable from each time there is a change in rolling conditions and the rolling state, and settable into the control calculation means 17. Rolling schedule data is provided to the setting means by a host computer (not shown in the drawings) this being used for the purpose of managing rolling schedule data, with calculations such as that of the weighting parameter $C_1$ being based on that rolling schedule data.

By doing this, the control calculation means 17 can be set from the setting means 25, thereby simplifying the control means.

Although the embodiment described above shows the application of the present invention to a rolling mill having a four-high roll configuration and a motor-driven looper, the present invention can be applied as well to rolling mills using other methods.

In a control device for a hot-rolling mill according to the present invention, when controlling the tension of the rolled material by means of a looper, it is possible to specify the response and the robust stability of the rolled material tension and looper height, making it possible to perform operations with a balance achieved between the rolling mill main electric motor and the looper. By doing this, it is possible to suppress variations in tension, and to achieve stable optimum control of both the looper and the tension, responsive to changes in rolling conditions and the rolling state.

In a control device for a hot-rolling mill according to the present invention, because the design is made for a high degree of robust stability, even in the case in which the numeric table of past is used, the table can be made small, thereby simplifying its maintenance and management.

In addition, because a state feedback type of controller is used as the control calculation means, when implementing the controller by means of a digital computer, the control conditions are made more lenient in terms of the control interval, enabling a broad range of application. With a state feedback configuration, the construction of the controller is simple, and the significance of each of the control gains is clarified, thereby simplifying on-site adjustments, this resulting in a shortening of the adjustment time, enabling the rolling mill to be started up quickly.

What is claimed is:

1. A control device for a continuous hot-rolling mill having a number of stands, each of which are driven by a main rolling mill electric motor, said control device comprising:

a main rolling mill electric motor speed detector which detects a rotational speed of said rolling mill main electric motor;

a main electric motor speed control means which compares the detected value of said speed detector with a main electric motor speed reference value and controls the rotational speed of said rolling mill main electric motor;

a tension detection means which is disposed between said number of stands and which detects a tension of said material which is being rolled by said stands;

a looper which controls the tension in said rolled material by means of adjusting a height of said looper;

a height detector which detects the height of said looper;

a looper electric motor which drives and adjusts the height of said looper;

a looper electric motor speed detector which detects a rotational speed of said looper electrical motor; and a looper electric motor speed control means which compares the detected value of said looper electric motor speed detector with a looper electric motor speed reference value and controls a drive speed of said looper electric motor, wherein said looper electric motor speed reference value is formed based on the detected values of the tension detection means, the height detector, and the looper electric motor speed detector, a setting means, a control gain calculation means, and a control calculation means, said setting means setting in said control calculation means a tension target value for said rolled material tension and a looper height target value and setting in said control gain calculation means the values of variables in a process model of a multivariable system, a weighting parameter for reducing the tension, a weighting function for specifying the response and robust stability of the looper tension and a weighting function for specifying the response and robust stability of the looper height, said control gain calculation means calculating the control gain from the process model variable values, a weighting parameter of said looper height, and a weighting function of said looper tension, the control calculation means receiving the tension target value, looper height target value and the weighting parameter from said setting means, the control gain from said control gain calculation means, and the detected values from said main electric motor speed detector, said looper electric motor speed detector, said tension detector, and said height detector, and calculating the rotational speed command value for said main motor speed controlling means which controls the speed of said main electric drive motor of said rolling mill, and the rotational speed command value for said looper main electric motor speed control means which controls said looper main electric motor, so as to obtain a tension deviation between the tension target value and the tension and a deviation between the looper height target value, and the looper height so as to change the looper height target value by multiplying the tension deviation by the weighting parameter and adding the looper height target value thereto.

2. A control device for a continuous hot-rolling mill according to claim 1, wherein said control calculation means has a state feedback configuration.

3. A control device for a continuous hot-rolling mill according to claim 1, wherein said control gain calculation means holds the calculated control gain in a setting means, and wherein said control calculation means selects and outputs the held control gain.

* * * * *